United States Patent [19]

Riehl

[11] 4,418,456

[45] Dec. 6, 1983

[54] TUBULAR BURNER CONSTRUCTION AND METHOD OF MAKING THE SAME

[75] Inventor: Fred Riehl, Greensburg, Pa.

[73] Assignee: Robertshaw Controls Company, Richmond, Va.

[21] Appl. No.: 318,031

[22] Filed: Nov. 4, 1981

[51] Int. Cl.[3] ..... F23D 13/36

[52] U.S. Cl. ..... 29/157 C; 239/566; 431/354

[58] Field of Search ..... 239/556–559, 239/566–568, 600; 431/284, 349, 354; 48/180 F; 29/157 C

[56] References Cited

U.S. PATENT DOCUMENTS

| | | | |
|---|---|---|---|
| 2,044,528 | 6/1936 | Guhl | 239/566 X |
| 3,578,891 | 5/1971 | Cavestany et al. | 431/286 X |
| 3,647,146 | 3/1972 | Genbauffe | 239/559 |
| 3,874,839 | 4/1975 | Riehl | 239/566 X |
| 4,346,845 | 8/1982 | Meyerhoff et al. | 431/354 X |

FOREIGN PATENT DOCUMENTS

| | | | |
|---|---|---|---|
| 1184844 | 3/1970 | United Kingdom | 239/566 |

*Primary Examiner*—Andres Kashnikow

*Attorney, Agent, or Firm*—Candor, Candor & Tassone

[57] ABSTRACT

A tubular burner construction having a wall defining a longitudinal fuel receiving chamber therein, the wall having ports provided therein and leading from the chamber to the exterior of the burner construction for issuing fuel from the chamber. The wall comprises two separate substantially like parts secured together at open ends thereof to define the tubular construction, the ports being provided in only one of the parts and inboard of the open end thereof.

10 Claims, 13 Drawing Figures

TUBULAR BURNER CONSTRUCTION AND METHOD OF MAKING THE SAME

BACKGROUND OF THE INVENTION

1. Field of the Invention

This invention relates to an improved tubular burner construction and to a method of making the same.

2. Prior Art Statement

It is known to provide a tubular burner construction having wall means defining a longitudinal fuel receiving chamber therein, the wall means having port means provided therein and leading from the chamber to the exterior of the burner construction for issuing fuel from the chamber.

For example, see the tubular burner construction illustrated in FIGS. 1 and 2 of this application.

Also see the U.S. patent to Genbauffe, U.S. Pat. No. 3,647,146.

It is also known to applicant to provide a burner construction wherein the wall means comprise two separate substantially like parts secured together at open ends thereof to define the burner construction with the port means being defined by cooperating surfaces at the joined together open ends of the like parts.

SUMMARY OF THE INVENTION

It is one feature of this invention to provide an improved tubular burner construction wherein an internal burr removal problem is eliminated.

In particular, it was found according to the teachings of this invention that a prior known tubular burner construction which has slotted ports provided therein by cutting through the exterior surface of the tubular burner construction with a saw or the like resulted in internal burrs adjacent the ports in the tubular burner construction that have to be removed as the same impede the flow of fuel out through such saw cut ports.

However, it was found according to the teachings of this invention that such a tubular burner construction can be formed from two like parts secured together at open ends thereof and the ports can be formed in one of those two parts completely inboard of the open end thereof before the two parts are secured together so as to eliminate the aforementioned internal burr problem.

For example, one embodiment of this invention provides a tubular burner construction having wall means defining a longitudinal fuel receiving chamber therein, the wall means having port means provided therein and leading from the chamber to the exterior of the burner construction for issuing fuel from the chamber. The wall means comprises two separate substantially like parts secured together at open ends thereof to define the tubular construction, the port means being provided in only one of the parts and inboard of the open end thereof.

Accordingly, it is an object of this invention to provide an improved tubular burner construction having one or more of the novel features of this invention as set forth above or hereinafter shown or described.

Another object of this invention is to provide an improved method of making such a tubular burner construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
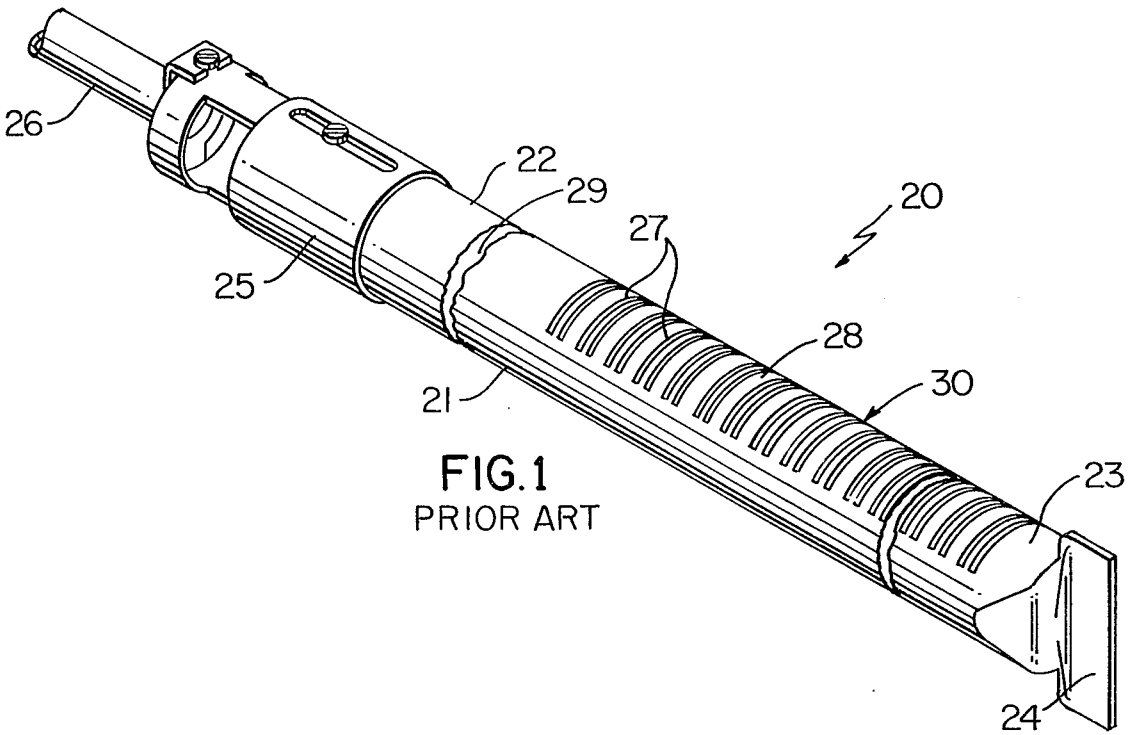
FIG. 1 PRIOR ART
FIG. 1 is an isometric view of a prior art tubular burner construction.

While the various features of this invention are hereinafter described and illustrated as being particularly adapted to provide a tubular burner construction for a cooking apparatus or the like, it is to be understood that the various features of this invention can be utilized singly or in any combination thereof to provide a tubular burner construction for other apparatus as desired.

Therefore, this invention is not to be limited to only the embodiments illustrated in the drawings, because the drawings are merely utilized to illustrate one of the wide variety of uses of this invention.

Figure 2:
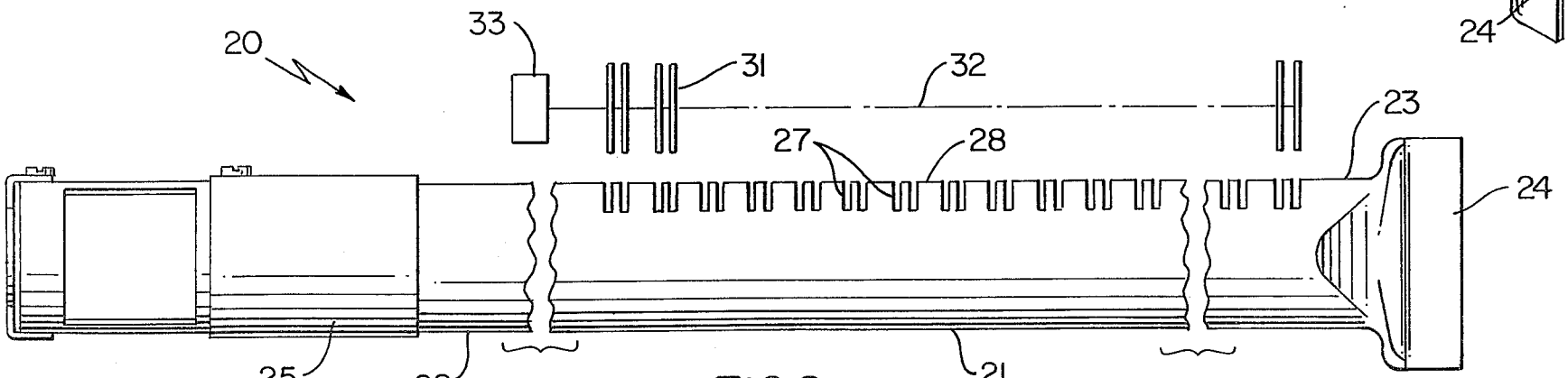
FIG. 2 PRIOR ART
FIG. 2 is an enlarged side view of the prior art tubular burner construction of FIG. 1 and schematically illustrates how the port means are cut into the same.

Referring now to FIGS. 1 and 2, a prior known tubular burner construction is generally indicated by the reference numeral 20 and comprises a one-piece tubular member 21 having opposed ends 22 and 23, the end 23 being formed closed and shaped to provide a front mounting bracket portion 24 while the other end 22 is open and is adapted to receive a suitable air shutter and orifice means 25 for permitting fuel to be injected into the interior thereof from a fuel supply nozzle 26 in a manner well known in the art.

The tubular member 21 has a plurality of ports 27 formed through the top surface 28 thereof for issuing fuel from the internal chamber 29 thereof to the exterior thereof in a manner well known in the art, the ports 27 being formed substantially transverse to the longitudinal axis of the tubular member 21 and in pairs 30 that are disposed spaced from each other by a distance greater than the spacing between adjacent ports 27 in each pair 30 thereof.

In order to form the slots or ports 27 in the tubular member 21, rotary saw blades 31 mounted on a shaft 32 in proper spaced relation are rotated by a suitable drive means 33 so that the blades 31 will engage against the exterior surface 34 of the tubular member 21 and cut into the same to form the slots 27 in the pattern determined by the fixed position of the blades 31 on the rotatable shaft 32 as illustrated schematically in FIG. 2.

However, as previously stated, it was found that when cutting the ports 27 in the tubular member 21 from the exterior thereof to the interior thereof, burrs are formed internally of the tubular member 21 adjacent the ports 27 which impede the flow of fuel through the ports 27 so that such burrs have to be removed before the tubular member 21 can be formed into the burner construction 20 as illustrated in FIGS. 1 and 2.

It was found according to the teachings of this invention that a tubular burner cnstruction can be provided which will not have any internal burr problem and will have further advantages over the prior known tubular burner construction 20 previously described as will be apparent hereinafter.

Figure 8:
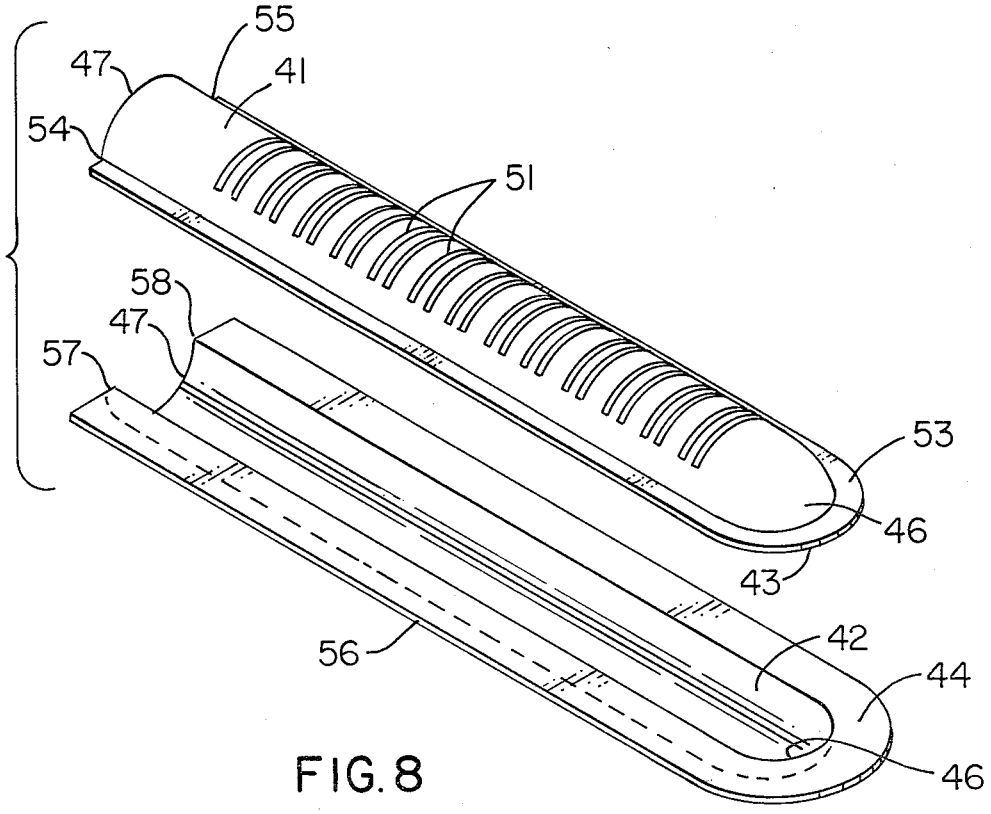
FIG. 8 is an exploded isometric view illustrating the two substantially like parts of this invention for forming the tubular burner construction of FIG. 3.
Figures 9, 10, 11, 12:
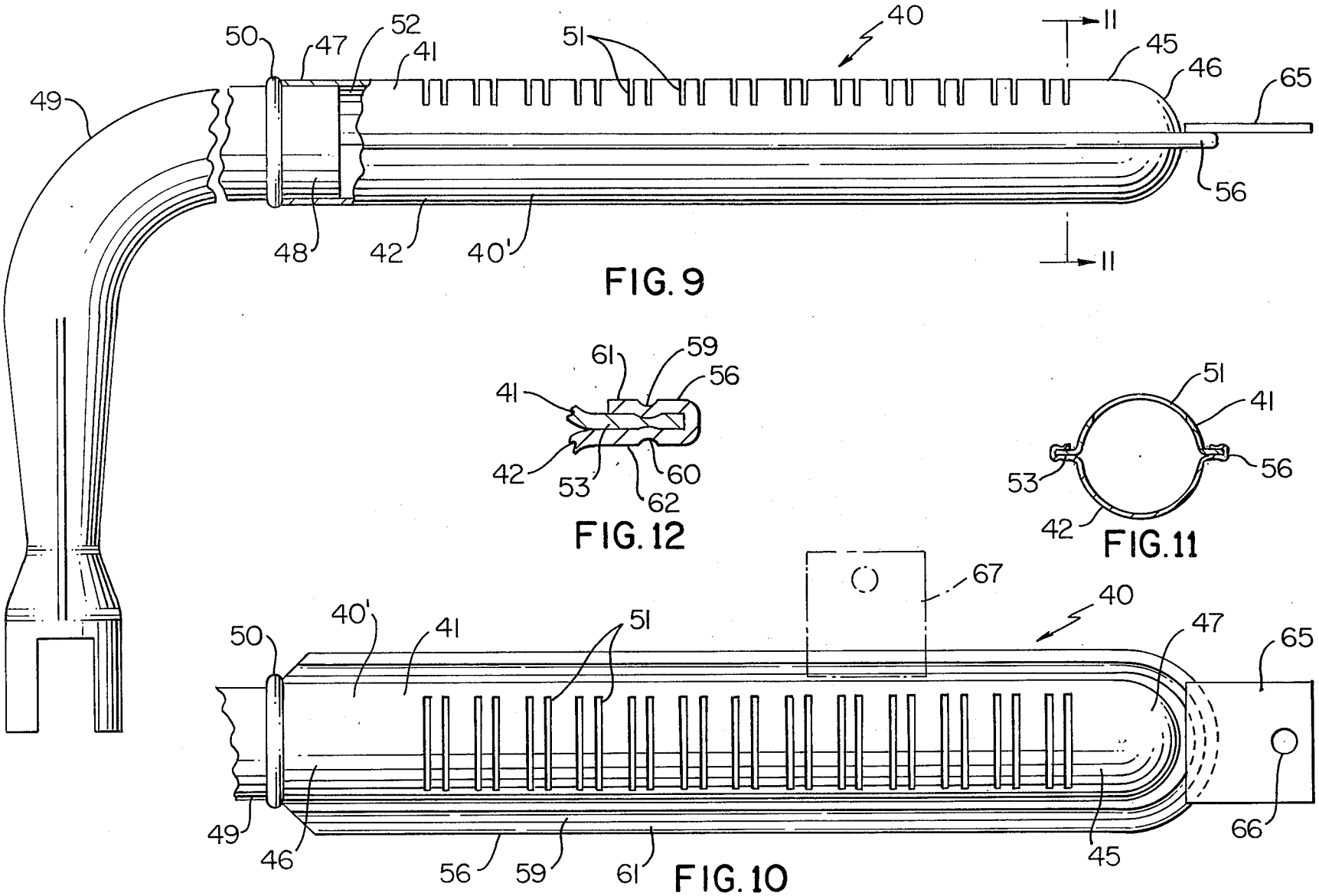
FIG. 9 is an enlarged side view, partially broken away, illustrating the tubular burner construction of this invention that is illustrated in FIG. 3.
FIG. 10 is a fragmentary top view of the tubular burner construction of FIG. 9.
FIG. 11 is a cross-sectional view taken on line 11—11 of FIG. 9.
FIG. 12 is an enlarged fragmentary portion of the cross-sectional view illustrated in FIG. 11 and illustrates the seam of the side flanges thereof.

In particular, reference is now made to FIGS. 3, 9 and 10 wherein an improved tubular burner construction of this invention is generally indicated by the reference numeral 40 and comprises a tubular member 40' formed from two separate substantially like parts 41 and 42 secured together at respective open ends 43 and 44 thereof (FIG. 8) in a manner hereinafter described to define a tubular wall means 45 of the tubular member 40' having opposed ends 46 and 47, the end 46 being closed and the end 47 being open and adapted to telescopically receive a tubular part 48 of a Venturi tube 49 as illustrated in FIG. 9 and be secured thereto in such telescoping relation in any suitable manner. For example, the end 47 can be spot welded onto the telescoped end 48 of the Venturi tube 49 and be sealed thereto with a suitable paste against a rib 50 of the Venturi tube 49 as illustrated.

While the Venturi tube 49 is illustrated as being bent at 90°, it is to be understood that straight Venturi tube or other bent Venturi tubes can be utilized in the same manner as the tube 49, as desired.

The part 41 of the wall means 45 of the tubular burner construction 40 has ports 51 formed therethrough and leading from an internal chamber 52 of the tubular burner construction 40 for issuing fuel fed into the chamber 52 by the Venturi tube 49 so as to heat an oven of a cooking apparatus or the like, the ports 51 being formed in substantially the same pattern as the ports 27 of the prior known tubular burner construction 20. However, it is to be understood that the ports 51 can be formed in any desired pattern thereof, if desired. In any event, it can be seen that the ports 51 are formed comletely inboard of the open end 43 of the part 41 for a purpose hereinafter described.

The open end 43 of the part 41 of the tubular burner construction 40 has an outwardly directed substantially flat peripheral flange 53 that extends from one side 54 of the open end 47 of the part 41 completely around the closed end 46 thereof to the other side 55 of the open end 47 thereof as illustrated in FIG. 8. Similarly, the other part 42 has an outwardly directed substantially flat peripheral flange 56 that extends from one side 57 of the open end 47 thereof completely around the closed end 46 thereof to the other side 58 of the open end 47 thereof, the peripheral flange 56 of the part 42 being shown wider than the peripheral flange 53 of the part 41 in FIG. 8 because the peripheral flange 53 of the part 41 has been trimmed, but initially was of the same width as the flange 56 as will be apparent hereinafter.

Figure 3:
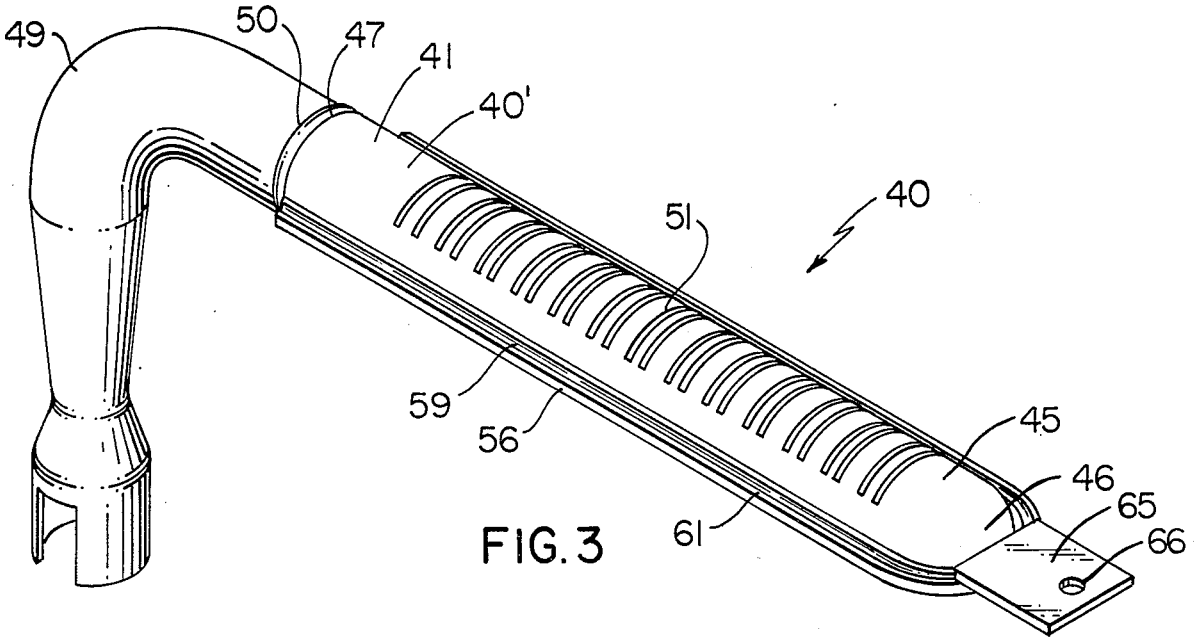
FIG. 3 is an isometric view of the improved tubular burner construction of this invention.

When the two parts 41 and 42 are assembled together so that their open ends 43 and 44 are adjacent each other, the flange 56 of the lower part 42 is turned or folded over the flange 53 of the upper part 41 as illustrated in FIGS. 11 and 12 and is crimped thereby by the rolling seam or ridges 59 and 60 in opposed folded parts 61 and 62 of the turned-over flange 56 as illustrated in FIG. 12 to completely seal closed the chamber 52 from the sealed flanges 53 and 56, the rolled seam or ridges 59 and 60 extending all the way from one side 63 of the open end 47 of the tubular member 40' around the closed end 46 to the other side 64 of the open end 47 thereof as illustrated in FIGS. 3 and 10.

Not only does the seamed flanges 53 and 56 of the parts 41 and 42 secure the parts 41 and 42 together to form the tubular member 40', but also such seamed flanges 53 and 56 readily permit structure to be mounted to the tubular burner construction 40.

For example, a rectangular plate can be welded or otherwise fastened to the turned-over part 61 of the flange 56 at the end 46 of the tubular burner construction 40 as illustrated in FIGS. 3, 9 and 10 to provide a front-mounting bracket for the tubular burner construction 40 as the plate 65 has an opening 66 passing therethrough to permit the same to be bolted to any suitable structure.

Also, it can readily be seen in FIG. 10 that a similar plate 67 is schematically illustrated as being secured to the top surface 61 of the turned-over flange 56 intermediate the opposed ends 46 and 47 of the tubular member 40' for mounting a pilot burner on the like adjacent the ports 51.

While any suitble means can be utilized to form the parts 41 and 42 of this invention, one method and apparatus of this invention for forming the parts 41 and 42 is schematically illustrated in FIGS. 4–7 and will now be described.

Figure 4:
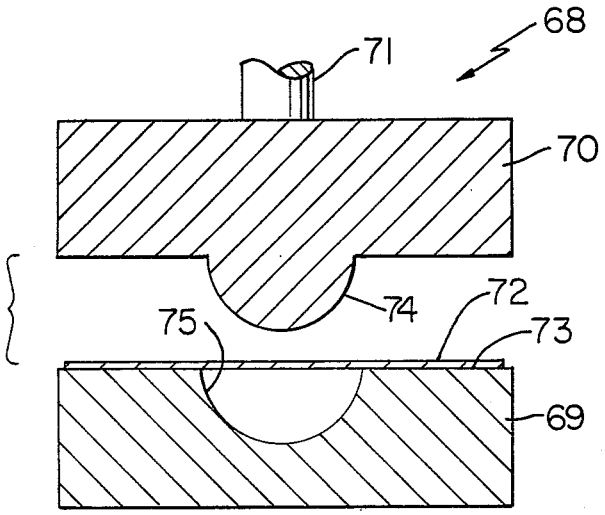
FIG. 4 is a schematic cross-sectional view illustrating one step in the method of this invention for forming the tubular burner construction of FIG. 3.
Figure 5:
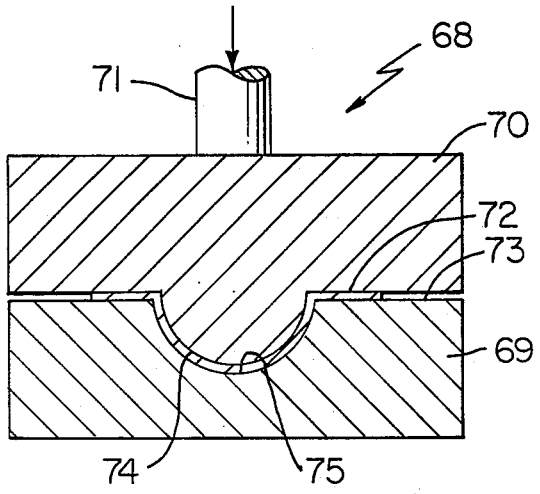
FIG. 5 is a view similar to FIG. 4 and illustrates another step in the method of this invention for forming the tubular burner construction of FIG. 3.

As illustrated in FIG. 4, a stamping apparatus is generally indicated by the reference numeral 68 and comprises a lower stationary die member 69 and a movable upper die member 70 interconnected to a suitable ram means 71 whereby a substantially flat blank 72 of metallic material is adapted to be disposed on the top surface 73 of the lower stationary die member 69 and be shaped into the configuration illustrated by the part 42 in FIG. 8 when the upper die member 70 has its die surface 74 engaged against the blank 72 to conform the same to the die surface 75 of the lower die member 69 in the manner illustrated in FIG. 5.

While any suitable material can be utilized for the blank 72, the same can comprise aluminized steel or stainless steel of approximately 0.031 of an inch thick.

Since the parts 41 and 42 of each burner construction 40 are substantially identical, the apparatus 68 can form a supply of parts 42 from the blanks 72 that can be stored until it is desired to form a burner construction 40.

Figure 6:
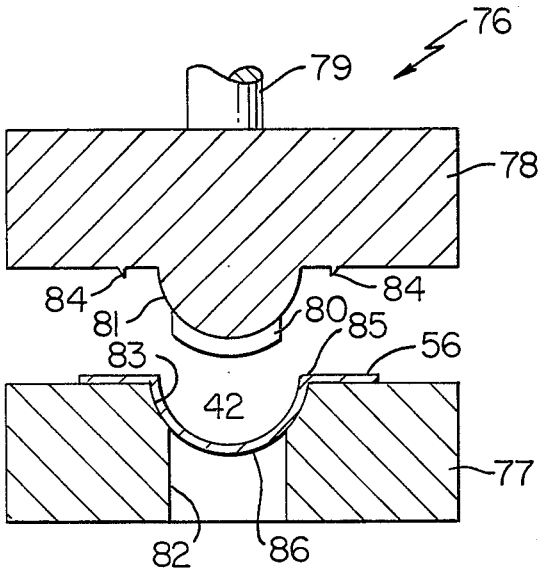
FIG. 6 is a schematic view illustrating another step in the method of this invention for forming the tubular burner construction of FIG. 3.
Figure 7:
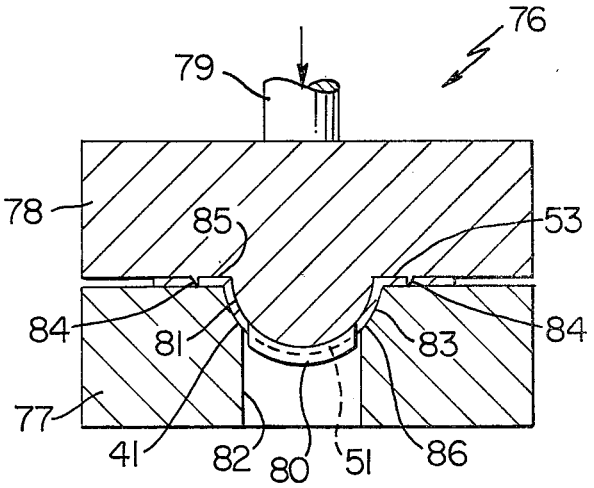
FIG. 7 is a view similar to FIG. 6 and illustrates another step in the method of this invention for forming the tubular burner construction of FIG. 3.

When it is desired to form a burner construction 40, one of the parts 42 can be disposed in the apparatus that is generally indicated by the reference numeral 76 in FIGS. 6 and 7 and which comprises a lower stationary die member 77 and an upper movable die member 78 interconnected to a suitable ram 79 or the like and having a plurality of removable cutting knives 80 on the die surface 81 thereof with the knives 80 being spaced on the die surface 81 to correspond to the desired pattern of ports 51 that are to be formed through the blank part 42 as illustrated in FIG. 6. Similarly, the lower die member 77 has cooperating slots 82 formed in the die surface 83 thereof for respectively receiving the knives 80 in the manner illustrated in FIG. 7 when the die parts 78 and 77 are brought together to force the knives 10 through the blank part 42 to form the ports 51 as illustrated in FIG. 8.

If desired, the upper die member 78 can also be provided with trimming knife edges 84 on the die surface 81 which will cut the flange 56 of the part 42 to conform the flange 56 into the smaller flange 53 of the resulting part 41 being formed by the apparatus 76 from the original part 42 as the die members 78 and 77 are brought together as illustrated in FIG. 7.

Therefore, it can be seen that the port 41 is formed from a previously formed part 42 to cooperate with another part 42 to form the tubular burner construction 40 through the seaming operation of the flanges 56 and 53 in the manner previously described.

Thus, since the ports 51 are being formed from the concave side 85 of the blank part 42 through to the convex side 86 thereof by the apparatus 76 as illustrated in FIGS. 6 and 7, there is no internal burr problem provided by the part 41 when the same is secured to the part 42 to form the burner construction 40 as to provided by the tubular burner construction 20 previously described.

Further, it can be seen that a plurality of parts 42 can be formed by the apparatus 68 of FIGS. 4 and 5 and subsequently some of those parts 42 can be converted to the parts 41 by the apparatus 76 in a relatively simple and effective manner to subsequently form the tubular member 40' of the burner construction 40 as previously described.

After the tubular member 40' has been formed in the manner previously described, the Venturi tube 49 is interconnected thereto in the manner previously described so that fuel can be directed into the chamber 52 to issue out of the ports 51 to be ignited by suitable ignition means in a conventional manner.

Because the tubular member 40' of the burner construction 40 is formed from the parts 41 and 42 of this invention separate from the Venturi arrangement 49, the separate Venturi section 49 can be made of less costly steel than the material forming the parts 41 and 42 of this invention because the high temperatures encountered adjacent the ports 51 require the parts 41 and 42 to be formed of a more costly material than the material forming the Venturi tube 49 which is disposed remote from the ports 51.

In fact, it may be found that the upper part 41 of the tubular burner construction 40 can be formed of one material and the lower part 42 thereof can be formed of another material that is less costly than the material of the upper part 41, if desired.

While the burner construction 40 has been illustrated in FIGS. 3, 9 and 10 as having a Venturi tube 49, it is to be understood that the tubular member 40' can be utilized with other structure for feeding fuel to the chamber 52 thereof.

Figure 13:
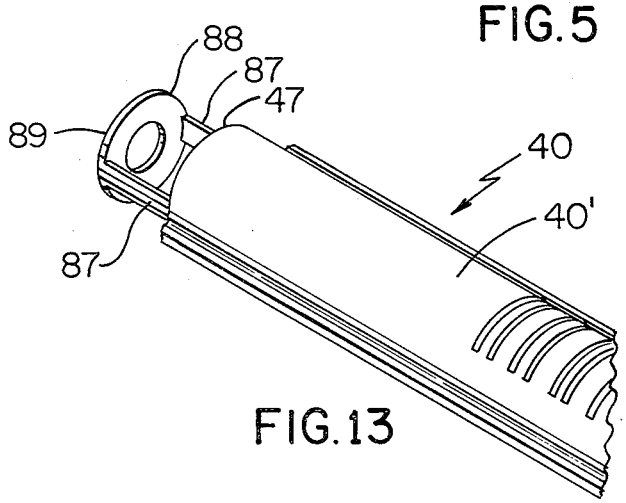
FIG. 13 is a fragmentary isometric view illustrating another tubular burner construction of this invention.

For example, reference is made to FIG. 13 wherein the tubular burner member 40' of this invention has the legs 87 of a U-strap 88 inserted into the open end 47 of the tubular burner construction 40 and being secured thereto by spot welding or the like whereby the cross member 89 of the U-strap 88 can be utilized for the orifice support of a fuel supply means 26 of the burner construction 20 previously described.

Therefore, it can be seen that this invention not only provides an improved tubular burner construction, but also this invention provides an improved method of making such a tubular burner construction or the like.

While the forms and methods of this invention now preferred have been illustrated and described as required by the Patent Statute, it is to be understood that other forms and method steps can be utilized and still fall within the scope of the appended claims.

What is claimed is:

1. In a method of making a tubular burner construction having wall means defining a longitudinal fuel receiving chamber therein, said wall means having port means provided therein and leading from said chamber to the exterior of said burner construction for issuing fuel from said chamber, said wall means comprising two separate substantially like parts secured together at open ends thereof to define said tubular construction, the improvement comprising the steps of stamping each port from the same sized blank with a first pair of dies so that each part is initially substantially identical and has an outer peripheral flange means at said open end thereof, forming said port means with a second pair of dies in only one of said parts and inboard of said open end thereof while at the same time cutting away part of said flange means with said second pair of dies so that the peripheral flange means of said one part is shorter throughout its width than said peripheral flange means of the other of said parts, and securing said flange means of said parts together by turning said flange means of one of said parts over said flange means of the other of said parts and crimping said flange means together to seal said flange means to each other.

2. A method of making a tubular burner construction as set forth in claim 1 and including the step of forming said port means to comprise a plurality of pairs of substantially uniform ports with each port comprising an elongated slot formed through said wall means.

3. A method of making a tubular burner construction as set forth in claim 2 and including the step of forming the ports of each pair thereof to be disposed substantially parallel to each other.

4. A method of making a tubular burner construction as set forth in claim 3 and including the step of forming each pair of ports to be disposed substantially parallel to the pair of ports disposed adjacent thereto.

5. A method of making a tubular burner construction as set forth in claim 4 and including the step of forming each port to have the slot length thereof disposed substantially transverse to the longitudinal axis of said burner construction.

6. A method of making a tubular burner construction as set forth in claim 1 and including the steps of forming said tubular burner construction to have opposed ends, forming one of said opposed ends to be open to said chamber for receiving fuel therein, forming the other of said opposed ends to be closed to said chamber, and extending said flange means of each part of said wall means from one side of said open end and around said closed end to the other side of said open end.

7. A method of making a tubular burner construction as set forth in claim 6 and including the step of securing a mounting bracket to said flange means at said closed end of said tubular burner construction.

8. A method of making a tubular burner construction as set forth in claim 6 and including the step of securing a member to said flange means so that said member will be carried adjacent said tubular burner construction.

9. A method of making a tubular burner construction as set forth in claim 1 and including the step of forming each said part of said wall means by stamping said blank thereof with said first pair of dies so as to have a concave side thereof and convex side thereof whereby said concave sides of said parts face each other to define said chamber when said open ends are secured together.

10. A method of making a tubular burner construction as set forth in claim 9 and including the step of forming said port means through said one part from said concave side thereof to said convex side thereof with said second pair of dies.

* * * * *